US012631340B2

(12) United States Patent
Graf et al.

(10) Patent No.: US 12,631,340 B2
(45) Date of Patent: May 19, 2026

(54) METHOD FOR MONITORING A COOKING PRODUCT, AND DOMESTIC COOKING APPLIANCE

(71) Applicant: BSH Hausgeräte GmbH, Munich (DE)

(72) Inventors: Martin Graf, Schaufling (DE); Mike Karl, Traunstein (DE)

(73) Assignee: BSH Hausgeräte GmbH, Munich (DE)

( * ) Notice: Subject to any disclaimer, the term of this patent is extended or adjusted under 35 U.S.C. 154(b) by 189 days.

(21) Appl. No.: 18/291,595

(22) PCT Filed: Jul. 7, 2022

(86) PCT No.: PCT/EP2022/068892
§ 371 (c)(1),
(2) Date: Jan. 24, 2024

(87) PCT Pub. No.: WO2023/011841
PCT Pub. Date: Feb. 9, 2023

(65) Prior Publication Data

US 2025/0084996 A1 Mar. 13, 2025

(30) Foreign Application Priority Data

Aug. 4, 2021 (DE) ..... 102021208447.8

(51) Int. Cl.
*F24C 7/08* (2006.01)

(52) U.S. Cl.
CPC ..... *F24C 7/085* (2013.01)

(58) Field of Classification Search
CPC ..... F24C 7/085
USPC ..... 382/100
See application file for complete search history.

(56) References Cited

U.S. PATENT DOCUMENTS

| | | | | |
|---|---|---|---|---|
| 10,634,366 | B1 | 4/2020 | Bentley | |
| 2012/0076350 | A1 | 3/2012 | Yoon | |
| 2018/0091721 | A1* | 3/2018 | Fukuda | H04N 23/73 |
| 2019/0242584 | A1* | 8/2019 | Ebert | F24C 7/085 |
| 2022/0065536 | A1 | 3/2022 | Beckmann | |

FOREIGN PATENT DOCUMENTS

| | | | |
|---|---|---|---|
| DE | 102019113281 | A1 | 11/2020 |
| EP | 3608593 | A1 | 2/2020 |

OTHER PUBLICATIONS

National Search Report DE 10 2021 208 447.8 dated May 5, 2022.
International Search Report PCT/EP2022/068892 dated Sep. 21, 2024.

* cited by examiner

*Primary Examiner* — Stephen P Coleman
(74) *Attorney, Agent, or Firm* — Michael E. Tschupp; Andre Pallapies; Brandon G. Braun

(57) ABSTRACT

In a method for monitoring food to be cooked that is located in a cooking compartment of a household cooking appliance during a cooking sequence based on a sequence of images captured with a camera, image parameters of the camera are automatically at a beginning of the cooking sequence, and the image parameters initially set by the camera are retained in a subsequent course of the cooking sequence until a predetermined event occurs.

13 Claims, 1 Drawing Sheet

METHOD FOR MONITORING A COOKING PRODUCT, AND DOMESTIC COOKING APPLIANCE

CROSS-REFERENCES TO RELATED APPLICATIONS

This application is the U.S. National Stage of International Application No. PCT/EP2022/068892, filed Jul. 7, 2022, which designated the United States and has been published as International Publication No. WO 2023/011841 A1 and which claims the priority of German Patent Application, Serial No. 10 2021 208 447.8, filed Aug. 4, 2021, pursuant to 35 U.S.C. 119 (a)-(d).

The contents of International Application No. PCT/EP2022/068892 and German Patent Application, Serial No. 10 2021 208 447.8 are incorporated herein by reference in their entireties as if fully set forth herein.

BACKGROUND OF THE INVENTION

The invention relates to a method for monitoring food to be cooked that is located in a cooking compartment of a household cooking appliance during an operating sequence, in particular a cooking sequence, on the basis of a sequence of images that is captured by means of a camera. The invention also relates to a household cooking appliance which is configured so as to implement the method. The invention can be advantageously used in particular to determine a degree of browning or browning progress, in particular in an oven.

DE 10 2019 113 281 A1 discloses a method for exposure control in a cooking appliance having an integrated camera, comprising: capturing a starting image using a predetermined basic exposure time; segmenting the starting image into surface portions of the food to be cooked and surface portions that are not the food to be cooked; creating an exposure mask for the surface portions of the food to be cooked, which hides the surface portions that are not the food to be cooked; adapting the exposure time using the exposure mask so that a predetermined target brightness of the surface portions of the food to be cooked is achieved; and capturing a target image using the adapted exposure time.

EP 3 608 593 A1 discloses a cooking system having (a) an oven having an oven cavity that is accessible via an oven door; and (b) an external computing means; wherein the oven is provided with (a1) at least one optical sensor for receiving image data in the oven cavity; (a2) means for detecting the closing of the door and for triggering the optical sensor; (a3) processing means for performing a basic image evaluation in order to determine whether the cavity is not empty; (a4) communication means for providing image data to the external computing means; wherein the external computing means is adapted to perform a food detection routine on the basis of the image data that has been provided by the communication means; (b2) selecting cooking parameters based on the determined food parameters; and (b3) transmitting the selected cooking parameters to the oven.

DE 10 2016 215 550 A1 discloses a method for determining a degree of browning of food to be cooked in a cooking compartment of a household cooking appliance, which has a camera that is oriented into the cooking compartment and a light source for illuminating the cooking compartment, and wherein a reference image is captured by means of the camera, a first measurement image is captured at a first brightness of the light source, a second measurement image is captured at a second brightness of the light source, a difference image is generated from the first measurement image and the second measurement image, and the difference image is compared with the reference image.

EP 2 444 733 A2 discloses an oven having a cooking compartment in which food is cooked; a heat source that heats the food in the cooking compartment; a light source that illuminates an inner part of the cooking compartment; an image sensor that scans the inner part of the cooking compartment and the food; a display part that displays an image of the food that is scanned by the image sensor; and a control part that corrects a food image that is distorted by light from the light source in order to display the corrected food image on the display part.

BRIEF SUMMARY OF THE INVENTION

The object of the present invention is to at least partially overcome the disadvantages of the prior art and in particular to provide a user-friendly possibility for the particularly reliable determination of a cooking progress, in particular browning progress, of food to be cooked during a cooking sequence on the basis of image sequences.

This object is achieved in accordance with the features of the independent claims. Preferred embodiments are apparent in particular from the dependent claims.

The object is achieved by a method for monitoring food to be cooked that is located in a cooking compartment of a household cooking appliance during an operating sequence on the basis of a sequence of images that is captured by means of a camera, in which, at the beginning of the cooking sequence, image parameters of the camera are automatically set and, in the subsequent course of the cooking sequence, the image parameters that are initially set are retained by the camera until at least one predetermined event occurs.

By "freezing" the image parameters or image parameter settings of the camera, this method results in the advantage that during the cooking process the food to be cooked is captured using the same image dynamic and therefore it is ensured that a change in the color and brightness of the food to be cooked in the captured images takes place only on the basis of an actual change on the surface of the food to be cooked and are not artefacts that are generated by image parameter adaptations of the camera. This in turn increases an accuracy and reliability of the determination of the cooking progress.

The operating sequence can be a cooking sequence that is set, for example, by a user or a cooking program. Alternatively, the operating sequence can be an operation to keep something warm, a pyrolysis sequence, etc. Reference is made below to a cooking sequence, wherein however other operating sequences can also be included, if applicable.

The fact that the initially set image parameters are retained at least until the occurrence of at least one predetermined event includes the possibility that, with the occurrence of a specific event, the image parameters of the camera can be reset or adapted, but do not need to be performed. This provides the further advantage that, in the event of a possible change in the lighting situation as a result of the event, the dynamic range of the camera can be automatically adapted to it and then also frozen again. As a result, changes in the color and brightness of the food to be cooked in the captured images can be detected particularly accurately after a changed lighting situation, which likewise increases an accuracy and reliability of the determination of the cooking progress.

The method advantageously also prevents a user from having to adapt image parameters themselves at the beginning of a cooking process or after the occurrence of the predetermined event, or from having to initiate the adaptation themselves, which further increases user satisfaction.

A further advantage is that the method can be reliably implemented by means of an inexpensive camera and simple evaluation logic. A complex and expensive solution having a high dynamic range, such as is used for example in DSLR cameras, is not necessary.

The method is based on the finding that if a change in the brightness or color impression of food to be cooked that is located in a cooking compartment occurs due to changed lighting conditions or color changes of the food to be cooked, a camera or a camera system typically automatically adapts to these new lighting conditions, for example by white and black balance, brightness balance, exposure time and, if necessary, further correction parameters. For this purpose, the camera constantly evaluates current image sections in order to set or adapt these image parameters for a subsequent image capture and thereby optimize the image capture, for example with regard to the best possible utilization of the dynamic range. For example, the exposure time can be adapted on the basis of the brightest image section, so that there is no significant overexposure of the image then captured. The white balance is determined, for example, on the basis of an image section that is considered almost white: if the camera finds such a white area, the color temperature adapts. Black values and other image parameters, in particular those influencing the dynamic range, are also automatically adapted to a specific scene. These adaptations are made because the dynamic range of a camera is not arbitrarily large and therefore a compromise must be made between several parameters that greatly influence each other and the scene. If images of a continuous cooking sequence are captured using this conventional method, each image capture is based on individually set or readjusted image parameters.

The method is based on the further finding that automatic adaptations of the image parameters for each captured image are disadvantageous in the case of an image sequence for a continuous cooking sequence, as is necessary, for example, for detecting browning of food to be cooked, since this changes the image dynamics of the images that are captured in an image sequence and as a consequence an assessment of the cooking progress, in particular browning progress, on the basis of the image sequence becomes less reliable during the cooking sequence.

The monitoring of the cooking progress can generally comprise an optical monitoring of a surface of the food to be cooked for a color change, for example after (greater) brown for a browning progress or in the case of non-browning or not-significantly browning food for another color change, for example from light green to dark green for certain vegetables, etc.

In one development, the household cooking appliance is an oven having a cooking compartment or has an oven, for example a stove. The food to be cooked that is located in the cooking compartment can be treated by introducing energy by means of resistance heating elements and/or IR radiators (oven), microwaves and/or steam. The household appliance can therefore also be a combination appliance, for example an oven/microwave combination appliance, an oven having steam treatment function, etc.

The household cooking appliance can have one or multiple cameras that are oriented into the cooking compartment. At least one camera can be arranged in or behind a wall of the cooking compartment. In one development, a camera corresponds to a camera sensor such as for example a CCD sensor. Alternatively, the camera can also comprise further components such as optics, in particular automatically adjustable optics, etc.

The fact that image parameters of the camera, which influence a dynamic range of the camera, are set at the beginning of the operating sequence can in particular include the image parameter settings being made once at the start of the cooking sequence (for example triggered by a user or a cooking program) and then all images of the image sequence being captured using the same image parameters until a predetermined event occurs. The image parameters can also be referred to as image capture parameters. "At the beginning" can be understood to mean "immediately after the beginning" or in a short time (for example between 1 and 30 s) after the beginning of the operating sequence.

The fact that the initially set image parameters are maintained until the occurrence of at least one predetermined event can also include the case that no such event occurs. In this case, the images are captured under the same initial image parameter settings until the end of the cooking sequence.

The image (capture) parameters can include inter alia an exposure time, a white balance, a black balance, a gain, a saturation, a color temperature, etc. The images of the image sequence can therefore be captured for example using the same exposure time and the same result of white balance and/or black balance at least until the occurrence of a predetermined event. In particular, the image parameters include all image parameters that are automatically adjustable or set by a camera. This is not precluded by the fact that one or multiple of the image parameters can also be set manually or by the user and/or there are other image parameters that can only be set manually.

In one embodiment, on the basis of a comparison of an image that is captured prior to the event and an image that is captured after the event, a check is performed as to whether the images have changed beyond a first, smaller predetermined extent or a second, larger predetermined extent as a result of the event, and

- if this is not the case, further images are captured without resetting the image parameters,
- if the images have changed beyond the first extent but not the second extent, image parameters of the camera are subsequently automatically reset once and further images are captured using the newly set image parameters, and
- if the images have changed beyond the second extent, at least one further action is performed.

This embodiment comprises in particular performing an image comparison of images prior to and after the event (for example determining a pixel-by-pixel deviation) and comparing the result of the comparison with the first and second extent. The result of the comparison can be, for example, a value that is dependent on the magnitude of the deviation, while the first extent and the second extent can be, for example, first and second threshold values, respectively.

This embodiment achieves the advantage that it is possible to check whether the lighting conditions and/or an optical characteristic of the surface of the food to be cooked have changed as a result of the event to such an extent that the image parameters that are initially set are also still suitable for the images that are captured after the event has ended or not. If so, the image parameters do not need to be changed, which results in the advantage that the image sequence that is captured after the event can be connected virtually seamlessly to the image sequence that is captured prior to the event. This can be advantageous, for example, if a cooking progress is determined from the image progression.

The second case results in the advantage that a dynamic range of the images can be improved and the image sequence that is captured after the event can still be connected in a practically meaningful manner to the image sequence that is captured prior to the event. Analogous to the setting of the image parameters at the beginning of the cooking sequence, in particular, the settings that are performed again for the following images are retained until the cooking sequence is terminated or a new event occurs, wherein with the occurrence of a new event, the image parameters are automatically set again once, etc. The new event can be a different event or the same event as the previous event.

The first and second cases render possible a particularly reliable determination of the cooking progress.

The third case takes into account the situation that the food to be cooked has changed so much that the sequence of images that is captured after the event can no longer be meaningfully connected to the sequence of images that is captured prior to the event. In the latter case, at least one ("further") action can then be triggered, for example the method can be aborted, or the method can be restarted. Reaching the second extent means that the image contents of the images have changed more than with reaching the first extent.

In one embodiment, the predetermined event comprises opening the door of the cooking compartment (in other words, opening and subsequently closing the door), which can be automatically detected, for example, by a door opening sensor. Analogous to the first case above, the images can practically not have changed due to the opening of the door, for example if a user only opens the door for a short time in order to take a closer look at the food to be cooked or to lightly pierce it. The image parameters of the camera for the image capture can then be retained since the opening of the door is usually too short to cause a change in the visual impression of the surface.

Analogously to the above second case, it is possible for the images to have changed slightly due to the opening of the door, for example when a user moves the food to be cooked or moves the associated food carrier to the next higher or next lower insertion level, which changes the lighting conditions only slightly and/or the food to be cooked is moved slightly.

The above third case can then occur, for example, if there is a change between levels of the food to be cooked, which are spaced further apart, for example from a lower level of the food to be cooked to a highest level of the food to be cooked, the food to be cooked has been turned over or stirred, the food to be cooked has been removed, food to be cooked has been added, the food to be cooked has been poured over or covered, for example with milk or sauce, etc.

In one embodiment, the predetermined event comprises an excessive rise or fall in at least one measured value of at least one non-imaging sensor. This can be implemented so that the predetermined event is considered to have occurred if at least one measured value (in other words a measured value, a sequence of measured values, or a derivative thereof) reaches or exceeds an upper threshold value and/or reaches or falls below a lower threshold value. A non-imaging sensor can be understood in particular as a sensor that is not a camera. This embodiment can be relevant, for example, if the surface of the food to be cooked changes particularly rapidly in a certain operating mode (for example "grill max"). When the operating mode is changed, a jump of a sensor signal can then occur, for example a jump of a sensor signal of a moisture sensor, oxygen sensor, etc.

The at least one non-imaging sensor can, include for example at least one sensor from the group

- Temperature sensor for sensing a surface temperature of the food to be cooked (for example an IR sensor);
- Core temperature sensor (also known as skewer);
- Moisture sensor;
- Lambda probe
- Chemical sensor, for example for detecting chemical substances that are released during browning;

but is not limited to this group. The lambda probe can be used, for example, as an oxygen sensor and/or moisture sensor.

In one embodiment, the predetermined event comprises an abrupt change of measured values of at least one non-imaging sensor. This can be implemented by evaluating a sequence of measured values. If, for example, the change of two consecutive measured values or measured value sequences exceeds a predetermined threshold value, this can be evaluated as an event.

In one embodiment, the predetermined event comprises a lapse of a predetermined time period, possibly under predetermined cooking parameters such as a predetermined cooking compartment temperature, operating mode, etc. In one development, the predetermined time period can be a backward or forward timer time period, for example when a set device switch-off is reached. A possible example is starting a post-cooking process. Alternatively or additionally, the predetermined time period can include reaching a jump mark in defined auto programs and baking operations.

In one embodiment, the predetermined event comprises a noticeable change in image contents of images that are captured one after the other using the camera. The evaluation of the image contents can comprise simple calculations of the values of the pixels, such as for example averaging and/or a difference analysis, as described for example in more detail below. This embodiment has the advantage that optical changes to the food to be cooked can be detected particularly promptly and continuously or quasi-continuously. The evaluation of the image contents can relate to the entire image or to at least one image section which shows the food to be cooked. The images or image sections that are used for the image comparisons can comprise successively captured images or images in a predetermined interval (for example every third, fourth, etc. image). The sensor here is the camera itself.

In one embodiment, in order to determine whether the images have changed beyond the at least one predetermined extent as a result of the event, a difference analysis is performed and an evaluation number that results from the difference analysis is compared with the first extent and, if then still necessary, with the second extent. In this way, a comparatively computationally simple and fast recognition is obtained of the extent to which the images or their image contents have changed. The images comprise at least one image that is captured prior to the event (in particular exactly one image, specifically of the last image prior to the event) and at least one image that is captured after the event (in particular exactly one image, specifically the first image after the event). The evaluation number represents the extent of an image deviation or image change between the compared images. This difference analysis can also be used analogously as an event, as already indicated above. A separate difference analysis to check whether the images have changed beyond a predetermined extent as a result of the event can then be omitted. In one embodiment, an average value of differences of corresponding pixel values of at least one image channel of the respective images is calculated as the evaluation number. The image parameters of the camera are reset or adapted if the evaluation number reaches or exceeds a predetermined threshold value. Such a difference analysis is advantageously particularly robust and can also be performed quickly. The difference analysis using the last image prior to the event and the first image after the event is particularly advantageous.

The image channels represent the channels or color space coordinates of the excluded images, for example the color space coordinates or color channels R, G and B for RGB images, the color space coordinates H, S and V for HSV images, etc.

In a particularly advantageous development, the average value is an arithmetic average value. Alternatively, for example, a geometric average value, a median value, etc., can be used.

In one development, the evaluation number is calculated in the form of the average value for all image channels. The average value D can then be calculated, for example, for an RGB image having an image width W and an image height H, a red value R1 (x, y) of a pixel having the coordinates (x, y) of the image 1, a green value G1 (x, y) of a pixel having the coordinates (x, y) of the image 1, a blue value B1 (x, y) of a pixel having the coordinates (x, y) of the image 1, a red value R2 (x, y) of a pixel having the coordinates (x, y) of the image 2, a green value G2 (x, y) of a pixel having the coordinates (x, y) of the image 2 and a blue value B2 (x, y) of a pixel having the coordinates (x, y) of the image 2 in accordance with $$D = \frac{\sum_{x=0}^{x=W-1}\sum_{y=0}^{y=H-1}|R1(x, y) - R2(x, y)| + |G1(x, y) - G2(x, y)| + |B1(x, y) - B2(x, y)|}{3 \cdot W \cdot H}$$

D=0 indicates that the two images are identical, D=255 means that the two images are very different. If the average value D reaches or exceeds a predetermined threshold value Thr, in other words if D>Thr or D>Thr applies, the image parameters for subsequent image captures are reset or adapted. The color values can be, for example, between 0 and 255, and then the value of D is also in the range from 0 to 255.

It is an advantageous development for saving computing power or for a faster calculation of the average value D that D is calculated on the basis of only one image channel.

In one development, the average value D for one, multiple or all image channels is calculated separately and the image parameters of the camera are reset or adapted if one, multiple or all average values D reach or exceed an associated, possibly also different, threshold value.

In one embodiment, a correlation coefficient of pixel values of at least one image channel of the respective images is calculated as the evaluation number, and the image parameters of the camera are reset if at least one correlation coefficient reaches or exceeds at least one threshold value. The calculation of a correlation coefficient is generally known and will therefore not be further elaborated. It is particularly advantageous if a linear correlation coefficient is calculated as the evaluation number. However, in principle, non-linear correlation coefficients can also be calculated as an evaluation number. Analogously to the above-described average value, the correlation coefficients for one, several or all image channels can also be calculated separately and compared with respective, possibly also different, threshold values.

In one development, the image parameters of the camera are set on the basis of the entire captured image, for example by means of performing a difference analysis over all pixels.

In one embodiment, the image parameters of the camera are set on the basis of only at least one image section of the captured image, which maps the food to be cooked. This results in the advantage that the dynamic range of the camera can be adapted particularly effectively to the food to be cooked and therefore the cooking progress can be monitored particularly reliably, since parts of the image that do not show the food to be cooked and do not change or do not change like the food to be cooked during a cooking process (for example, a food carrier or a wall of the cooking compartment) are not taken into account or at least not taken into account so much. This can be implemented, for example, in such a manner that the difference analysis is performed only via the pixels of the at least one image section.

At least one image section can be preset, for example a central area that omits an edge of the image, which usually shows a food carrier or a wall of the cooking compartment.

In a development, the at least one image section is determined by object recognition. This advantageously enables particularly good image separation between the food to be cooked and anything that is not the food to be cooked and thus a particularly accurate and reliable determination of a cooking progress. In this development, for example, at least one image section can be recognized and determined in a captured image, which, if possible, only shows food to be cooked. Such an object recognition of food to be cooked is fundamentally known and will therefore not be further elaborated.

In one embodiment, an object analysis is performed at least in the first (or one of the first) of the captured images, and the check as to whether the images have changed as a result of the event beyond a first, smaller predetermined extent or a second, larger predetermined extent is performed only on the basis of image sections that are determined by the object analysis. In a development, only the image sections that are determined by object analysis are used so as to determine a cooking progress or the like.

In one embodiment—as already indicated above for the third case—the at least one further action comprises performing an image analysis as to whether the food to be cooked

- has been rearranged (for example by moving between insertion levels which are further apart, turning and/or stirring),
- has been altered (for example, food to be cooked has been added, the food to be cooked has been poured over or covered, etc.),
- has been removed and/or
- has been replaced.

As a result, the type of image deviation can advantageously be determined and at least one further action can be performed in a targeted manner.

In one embodiment, the image analysis comprises object recognition on an image captured prior to the event and object recognition on an image captured after the event and a subsequent comparison of the results of the object recognitions. It is also possible to use artificial intelligence methods, etc., in order to obtain the most reliable result possible. The method has the advantage that a computationally complex image analysis is only performed if a large deviation in the image contents has previously been determined using computationally comparatively simple means.

Depending on the result that is obtained, another further action can include restarting the method, etc. The restart can comprise an automatic restart based on the result of the image analysis and the object that is detected after the event.

The object is also achieved by a household cooking appliance which is configured so as to implement or perform the above method. The household cooking appliance can be designed analogously to the method and has the same advantages.

Thus, in one embodiment, the household cooking appliance has a cooking compartment, which can be closed by means of a door, at least one camera that is oriented into the cooking compartment, and a data processing facility for evaluating the images that are captured by means of the at least one camera for a cooking progress of food to be cooked that is located in the cooking compartment.

The data processing facility can be, for example, a standalone data processing facility or can be functionally integrated into a control unit of the household cooking appliance.

The above-described characteristics, features and advantages of this invention and also the manner in which these are achieved become clearer and more easily understandable in conjunction with the following schematic description of an exemplary embodiment that is further explained in conjunction with the drawings.

DETAILED DESCRIPTION OF EXEMPLARY EMBODIMENTS OF THE PRESENT INVENTION

Figure 1:
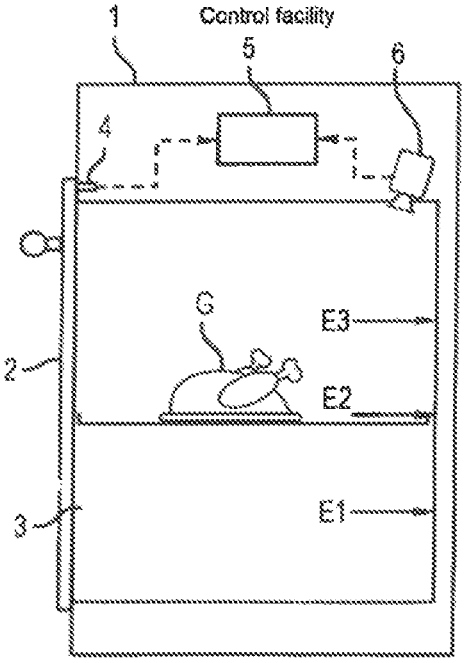
FIG. 1 shows a sectional side view of a simplified sketch of a household cooking appliance.

FIG. 1 illustrates a sectional side view of a sketch of a household cooking appliance in the form of an oven 1 having a heatable cooking compartment 2, the front loading hatch of which can be closed by a door 3. The closed door can be detected by a door opening sensor 4, for example, a micro switch, which is connected to a control facility 5. The control facility 5 is moreover connected to a camera 6 that is oriented into the cooking compartment 3. Food to be cooked G can be arranged in different insertion levels E1, E2, E3 in the cooking compartment 3. Lighting means (not shown) that are present in an upper region of the cooking compartment 3 are used to illuminate the cooking compartment 3 and the food to be cooked. The higher the insertion level E1 to E3, the more the food to be cooked G is illuminated and thus appears brighter. It is possible, by evaluating the images that are captured by the camera 6, to automatically determine which of the insertion levels E1 to E3 the food to be cooked G is arranged on (here: on the insertion level E2).

In the present case, in addition to controlling a cooking sequence, the control facility 5 is also configured so as to implement the method in accordance with the invention, which is used below, for example, to determine a cooking progress, in particular a degree of browning, of the food to be cooked G.

Figure 2:
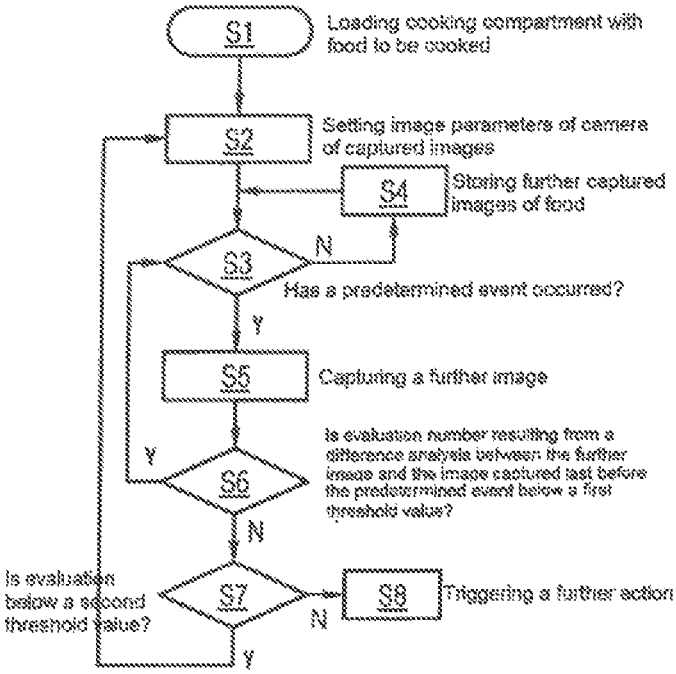
FIG. 2 shows a possible sequence of the method in accordance with the invention.

FIG. 2 illustrates a possible sequence of the method in accordance with the invention: In a step S1, the cooking compartment 3 is loaded with the food to be cooked G, cooking parameters such as a cooking compartment temperature, a type of heating (e.g. top heat, hot air, etc.), etc., are set, if necessary as part of an automatic cooking program, the door 2 is closed and the cooking sequence is started.

In a step S2, the image (capture) parameters of the camera 6 are now automatically set.

In a subsequent step S3, a check is performed as to whether a predetermined event, here: a door opening process (door 2 opening and closing again) has occurred. If this is not the case ("N"), further images of the food to be cooked G are captured and stored in a step S4 using these image parameters, and thus without their automatic adaptation to image changes. From this sequence of images, the cooking progress, for example a progress of a degree of browning, is determined in a manner known in principle. If a desired target degree of browning is reached, an indication is output to the user and/or the cooking process is terminated.

However, if a door-opening process is detected ("Y"), then in a step S5, a further image is captured under the same image parameters as before the door-opening process.

In a subsequent step S6, a difference analysis is performed on the basis of this image and the last image that is captured prior to the door opening process. If the resulting evaluation number is below a first threshold value Thr1 ("Y"), it is concluded that these two images practically do not differ—at least for the purpose of monitoring the cooking progress. In this (first) case, as shown, a branch is made back to step S3 or to step S4, and images are subsequently captured using the image parameters already previously defined in step S2.

If the evaluation number is above the first threshold value Thr1 ("N"), a branch is made to step S7, in which a check is performed as to whether or not the evaluation number is below a second threshold Thr2. If this is the case ("Y"), it is concluded that these two images are slightly different for the purpose of monitoring the cooking progress, but still show the same food to be cooked without rearranging, turning, altering, etc. This can be the case, for example, if a user has moved the food to be cooked G to a food to be cooked level E3. In this (second) case, a branch is made back to step S2 and the image parameters are reset. The following images are captured using the newly set image parameters and connected to the image sequence prior to the door opening.

If the evaluation number is above the second threshold value Thr2 ("N"), it is concluded that the two images no longer show the same food to be cooked or indeed show the same food to be cooked, but this has been altered in such a way that monitoring the browning progress by merging the image sequences prior to and after the event does not make sense. This can be the case for example if a user has turned, covered, removed or replaced the food to be cooked G. In this (third) case, at least one further action is triggered in a step S8, for example the monitoring of the browning progress is restarted, for example by branching back to step S2 without connecting the image sequence to the image sequence that is captured before the door is opened or, as shown, the method is aborted.

Of course, the present invention is not limited to the illustrated exemplary embodiment.

In general, "a", "an", etc., can be understood as a single number or a plurality, in particular in the sense of "at least one" or "one or multiple", etc., as long as this is not explicitly excluded, for example by the expression "exactly one", etc.

A number specification can also include exactly the specified number as well as a usual tolerance range, as long as this is not explicitly excluded.

The invention claimed is:

1. A method for monitoring food to be cooked that is located in a cooking compartment of a household cooking appliance during a cooking sequence based on a sequence of images captured with a camera, the method comprising:

automatically setting image parameters of the camera at a beginning of the cooking sequence;

retaining the image parameters initially set by the camera in a subsequent course of the cooking sequence until a predetermined event occurs, and capturing a first image prior to the predetermined event;

capturing a second image after the predetermined event;

comparing the first image and the second image;

checking as to whether the first and second images have changed beyond a first, smaller predetermined extent or a second, larger predetermined extent as a result of the predetermined event; and if the first and second images have not changed beyond the first predetermined extent or the second predetermined extent, capturing further ones of the images without resetting the image parameters of the camera, if the first and second images have changed beyond the first predetermined extent but not the second predetermined extent, subsequently automatically resetting image parameters of the camera once and capturing further images using the reset image parameters, and if the first and second images have changed beyond the second predetermined extent, performing a further action.

2. The method of claim 1, wherein the predetermined event comprises opening a door of the cooking compartment.

3. The method of claim 1, wherein the predetermined event comprises an excessive rise or fall of a measured value of a non-imaging sensor.

4. The method of claim 1, wherein the predetermined event comprises an abrupt change in a measured value of a non-imaging sensor.

5. The method of claim 1, wherein the predetermined event comprises a lapse of a predetermined time period.

6. The method of claim 1, wherein the predetermined event comprises a noticeable change in image contents of images that are captured one after the other using the camera.

7. The method of claim 1, further comprising:

performing a difference analysis when determining a change of the first and second images beyond at least one of the first and second predetermined extents as a result of the event; and comparing an evaluation number that results from the difference analysis with the first predetermined extent and, optionally, with the second predetermined extent.

8. The method of claim 7, further comprising:

calculating an average value of differences of corresponding pixel values of an image channel of a respective one of the first and second images as the evaluation number; and resetting the image parameters of the camera when the average value exceeds a threshold value.

9. The method of claim 7, further comprising:

calculating a correlation coefficient of pixel values of an image channel of a respective one of the first and second images as the evaluation number; and resetting the image parameters of the camera when the correlation coefficient reaches or exceeds a threshold value.

10. The method of claim 1, further comprising:

performing an object analysis at least in a first one of the captured images; and checking as to whether the first image has changed as a result of the predetermined event beyond a first, smaller predetermined extent or a second, larger predetermined extent only based on image sections determined by the object analysis.

11. The method of claim 1, wherein the further action comprises performing an image analysis as to whether the food to be cooked has been rearranged, altered, removed and/or replaced.

12. The method of claim 11, wherein the method is restarted, when determining as a result of the image analysis that the food to be cooked has been rearranged, altered, removed and/or replaced.

13. A household cooking appliance, comprising:

a cooking compartment designed to receive food to be cooked;

a door designed to close the cooking compartment;

a camera oriented into the cooking compartment; and a data processing facility designed to evaluate images captured by the camera for a cooking progress of the food to be cooked in the cooking compartment, wherein the household cooking appliance is configured to implement a method as set forth in claim 1.

* * * * *